United States Patent [19]

Gooray et al.

[11] Patent Number: 5,032,875

[45] Date of Patent: Jul. 16, 1991

[54] HEAT EXTRACTION TRANSPORT ROLL WITH ANNULUS

[75] Inventors: Arthur M. Gooray, Penfield; Robert P. Siegel, Rochester, both of N.Y.

[73] Assignee: Xerox Corporation, Stamford, Conn.

[21] Appl. No.: 943,465

[22] Filed: Dec. 19, 1986

[51] Int. Cl.[5] ..... G03G 15/20

[52] U.S. Cl. ..... 355/290; 355/285; 355/289

[58] Field of Search ..... 34/66; 432/228; 165/89, 165/133, 903; 355/3 FU, 14 FU, 30, 3 SH, 282, 285, 289, 290, 308

[56] References Cited

U.S. PATENT DOCUMENTS

| | | | |
|---|---|---|---|
| 3,827,855 | 8/1974 | Blake | 432/60 |
| 4,191,465 | 3/1980 | Boase et al. | 355/3 SH |
| 4,252,307 | 2/1981 | Korte | 346/138 |
| 4,545,671 | 10/1985 | Anderson | 355/3 SH |
| 4,618,240 | 10/1986 | Sakuvai et al. | 355/3 FU |
| 4,625,430 | 12/1986 | Aula et al. | 34/66 |

FOREIGN PATENT DOCUMENTS

| | | | |
|---|---|---|---|
| 0171977 | 9/1984 | Japan | 355/3 FU |
| 0104978 | 6/1985 | Japan | 355/3 FU |

*Primary Examiner*—Steven L. Stephan
*Assistant Examiner*—Judson H. Jones
*Attorney, Agent, or Firm*—William A. Henry, II

[57] ABSTRACT

A thermally conductive hollow cylinder is used in a copier as a heat dissipating sheet transport device in conjunction with an insulating and reflective baffle. The cylinder is located downstream of the fuser to dissipate heat placed on sheets by the fuser. Air is drawn through holes in the sheet contacting surface of the cylinder by a blower which vents heated air to the outside of the copier. A member can be placed inside the cylinder in order to create an annulus and thereby enable high velocities to be obtained near the outer wall of the cylinder without increasing the overall flow requirement.

9 Claims, 3 Drawing Sheets

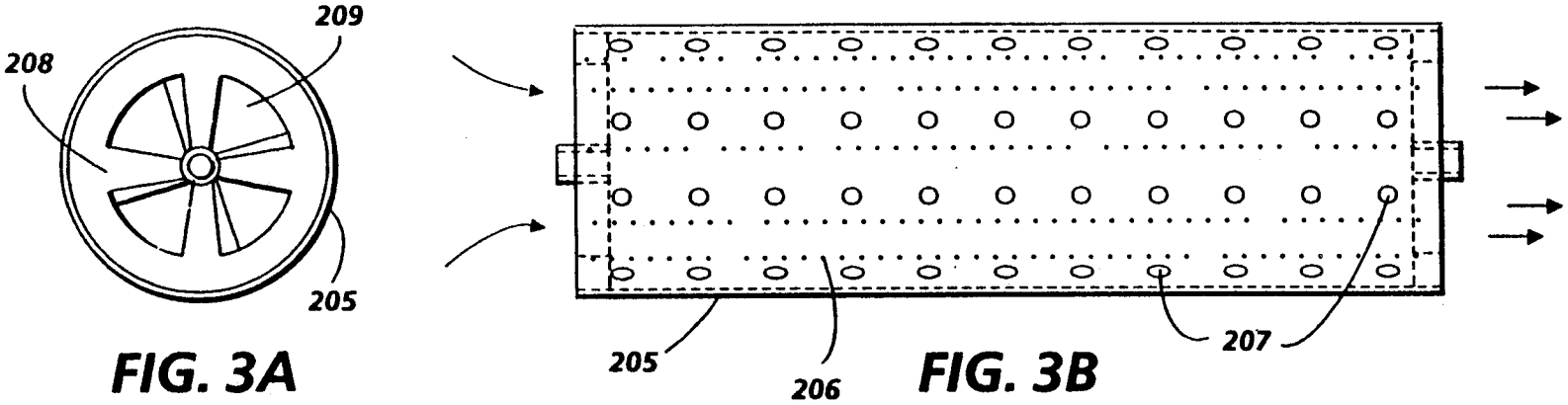
FIG. 3A
FIG. 3B
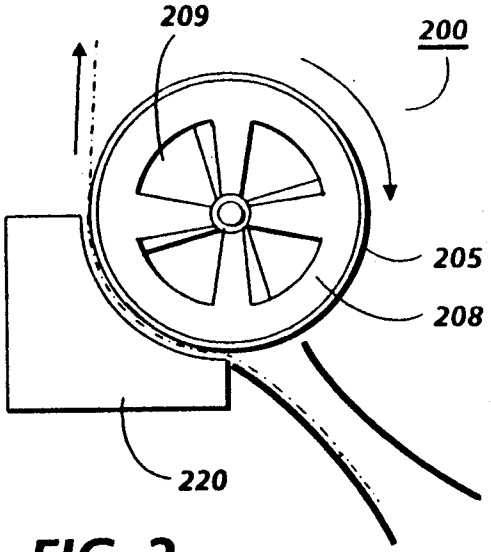
FIG. 2
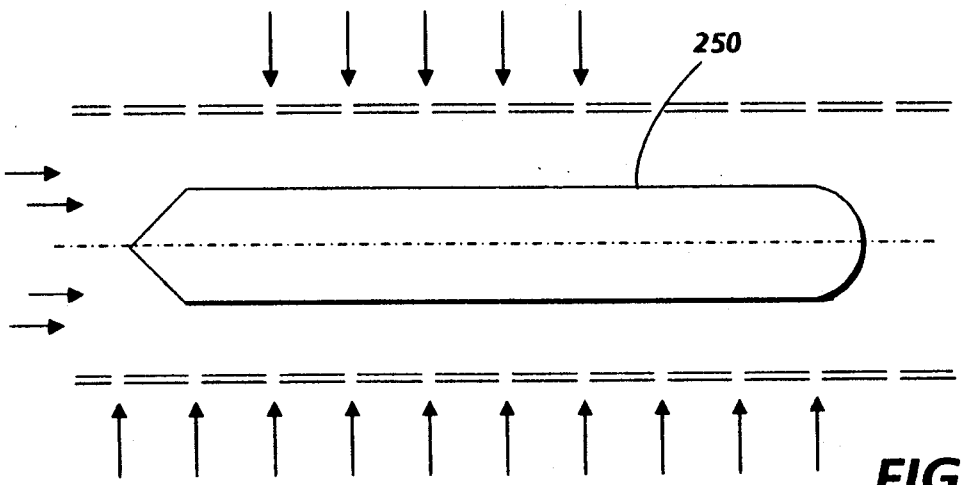
FIG. 4

HEAT EXTRACTION TRANSPORT ROLL WITH ANNULUS

This invention relates generally to an apparatus for transporting and cooling a heated image-carrying substrate along a given path. More particularly, this invention relates to an apparatus for simultaneously transporting and cooling a copy sheet carrying a fused toner image as it exits a heated fuser, while reducing the magnitude of the moisture gradient across the copy sheet.

Ordinarily, an image is placed onto the surface of a photoconductive member either by illuminating an original document which is projected upon the photoconductive member to produce a latent electrostatic image corresponding to the original document, or an image is placed onto the photoconductive member by electronic means. The latent electrostatic image is developed by means of fusible particles to produce a visible toner image which is transferred to a substrate such as a copy sheet. The unfused toner image may be fixed to the substrate by means of heat and pressure by passing the substrate through the nip of a pair of rollers, at least one of which is heated. A fused substrate exiting from the roller nip is in a tacky state having been heated by the heated roller. The substrate also has a tendency to curl due to drying out during fusing and due to the curvature of the fuser nip. This curl has been linked to the rate ata which mositure re-enters the sheet. Therefore, it is desirable to cool the substrate after it exits the fuser in order to minimize curling and to prevent substrates from sticking together in the exit tray. It has been shown that hot sheets absorb moisture at a higher rate than cool sheets.

Various techniques have been tried to reduce the heat level in copiers which is generated primarily by the fuser. For example, in the Xerox 1075® copier, the area above the fuser is cooled by a high capacity axial flow fan which cools the fuser. However, since an inverter is positioned above the fuser, the air from the fan can disturb operation of the inverter by fluttering lightweight sheets. Also, a decurler is used to handle any curl placed in copy sheet by the fuser. U.S. Pat. Nos. 3,914,097 and 4,545,671 both are directed to cooling sheets by the use of a perforated planar heat conductive surface. A vacuum supply provides suction through the perforations to provide a cooling air flow and to hold a sheet against the heat conductive surface. A perforated heated drum for fusing toner is shown in U.S. Pat. No. 3,827,855 and includes a vacuum supply which draws air through some of the perforations to hold paper against one portion of the drum, while a pressurized air source blows air out of other perforations to blow the paper off the drum. Both the vacuum and pressurized air supplies are fed to the drum through a central core. In U.S. Pat. No. 4,191,465 a paper feed roller is shown having a vacuum fed perforated surface. Most of the center of the feed roller appears to be filled by a central core.

Accordingly, a thermally conductive hollow cylinder having a plurality of holes in its surface is disclosed that is used to dissipate heat from copy sheets and to transport the copy sheets as they exit a fuser for further processing. An insulative and reflective baffle guides copy sheets around the cylinder. Air is drawn through the cylinder by means of a vacuum blower which vents to the outside of a machine. An annulus can be placed inside the cylinder in order to create high air velocities near the outer wall of the cylinder for improved heat transfer from the copy sheets.

The invention and its features and advantages will be set forth and become more apparent in the detailed description of the preferred embodiment presented below with references to the accompanying drawings, in which:

FIG. 2 is an enlarged elevational view rotated for clarity of the heat extraction transport roll in FIG. 1.

FIG. 3A is a view of the heat extraction transport roll.

FIG. 4 is a diagrammatic cross-sectional view of a cylinder as shown in FIG. 3B with an annulus member added and arrows indicating air flow patterns.

While the present invention will hereinafter be described in connection with preferred embodiments thereof, it will be understood that it is not intended to limit the invention to those embodiments. On the contrary, intended for coverage are all alternatives, modification and equivalents as may be included within the spirit and scope of the invention as defined by the appended claims.

Figure 1:
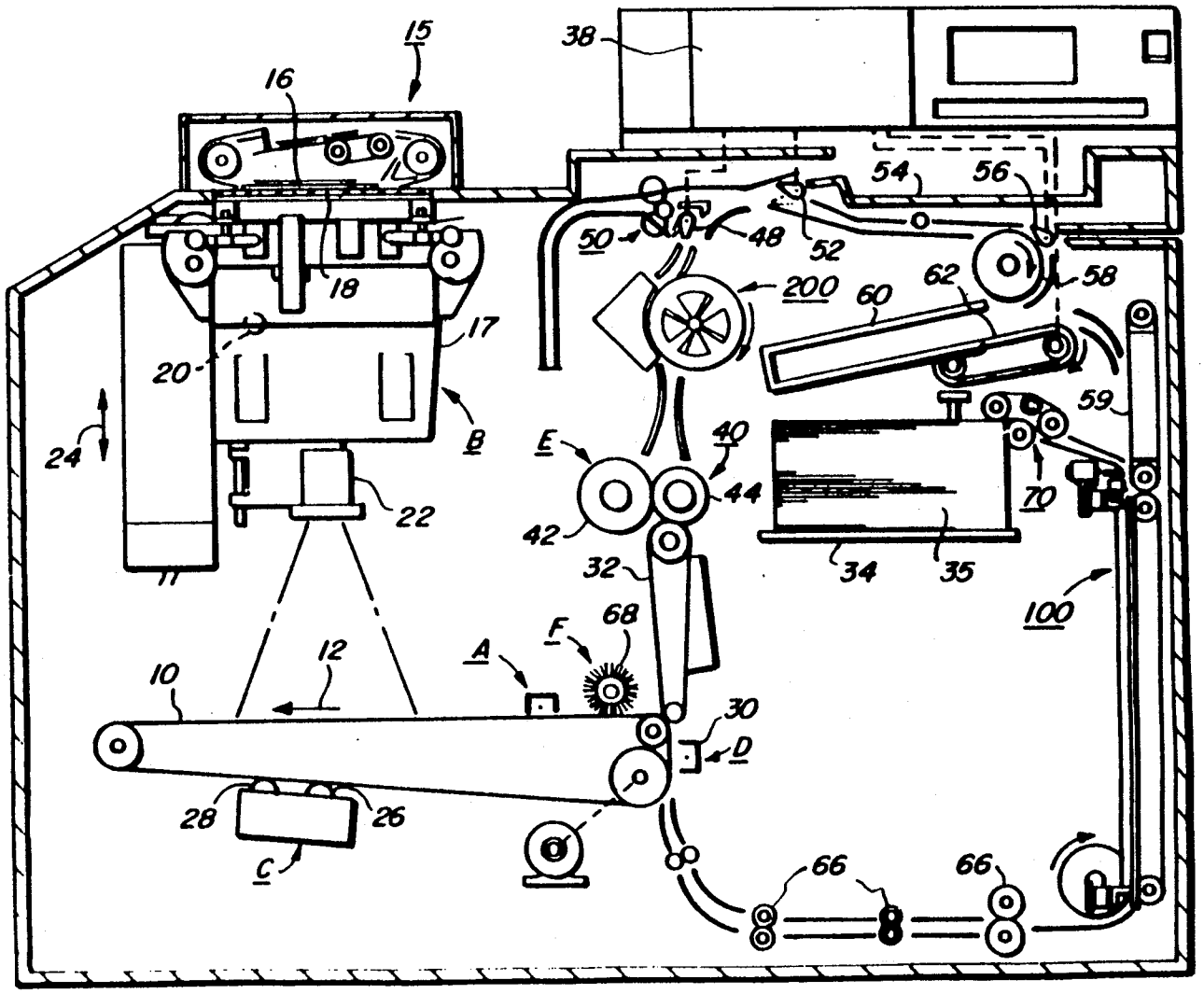
FIG. 1 is an elevational schematic of an apparatus employing a preferred embodiment of the present invention.

For a general understanding of the features of the present invention, reference is made to the drawing. In the drawings, like reference numerals, have been used throughout to designate identical elements. FIG. 1 schematically depicts the various components of an illustrative electrophotographic copying machine incorporating the heat extraction transport apparatus of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device charges the photoconductive surface to a relatively high substantially uniform potential.

Next, the charged portion of the photoconductive surface is advanced through imaging station B. At imaging station B, a document handling unit indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a copying or printing machine which does not include a document handling unit, or when one is making copies of A3 or 11"×17" documents where the document handler has to be raised up from the platen and the oversized document manually placed on the platen for copying.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules for the developer material to form a toner powder image on the photoconductive surface of belt 10.

After the electrostatic latent image recorded on the photoconductive surface of belt 10 is developed, belt 10 advances the toner power image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, heat extraction transport mechanism 200 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed to conveyor 59 seriatim by bottom feeder 52 back to transfer station D for transfer of the toner powder image to the opposed side of the sheet. Duplex feeder jam rates show a strong sensitivity to the amount of curl in the fused simplexed sheets. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

A large portion of the fuser contribution to the heat rise problem in copiers is the thermal energy that is transported as sensible heat in the fused copy sheet, and its entrained convective boundary layers. This energy is thermally dissipated in the machine or used to create curl in copy sheets due to moisture loss which subsequently must be decurled. With this energy problem transferred effectively from copy sheets to the environment, the heat rise problem is alleviated and the decurler requirement reduced or eliminated. The mechanism 200 for accomplishing this is shown in FIG. 2 and consists of a heat extraction transport roll including a thermally conductive hollow cylinder 205 which is used as a transport device in conjunction with an insulative and reflective baffle 220 made of a suitable material such as Delrin. Air is drawn through the core of the cylinder as well as through a plurality of holes 207 that extend through both the outer and inner surfaces of the cylinder by means of a blower connected to one end of the cylinder. Operation of the blower draws cool air through the endcap as well as through the holes in the outer surface of the cylinder which attaches or draws a copy sheet to that surface once it leaves the fuser. Fins in the endcap control the amount of cool air to be drawn axially with the heated radial flow. The copy sheet is transported for further processing by the rotation of the cylinder. Hot air drawn from the copy sheet by the thermally conductive cylinder and the blower and is vented to the outside of the machine through the opposite endcap of the cylinder. The flow rate through the cylinder is such that the heat transfer from the copy sheet to the cylinder will be adequate and the vacuum level will aid in heat dissipation as well as copy sheet transport. The diameter of the cylinder is such that a large contact zone is presented to the copy sheet. The impedance of the cylinder is high enough to enable a vacuum to be developed but low enough to permit a reasonable size blower.

Moisture liberated from a sheet upon exiting the fuser will tend to resorbed quickly, contributing to sheet curl, at a rate which is proportional to the sheet temperature. Curl formation is also highly related to the temperature of the sheet as it wraps around a tight radius. So to prevent curl it is essential to cool rapidly.

The surface of cylinder 205 is optimized as a rough, high friction transport surface which also serves as an enhanced heat transfer surface due to the increase in effective surface area provided by raised elements 206 which act as fins. This roughness also aids considerably in propagating the low pressure field which is used to tack the copy sheet to the surface of the cylinder and thereby aids its copy sheet handling effectiveness. It is also contemplated that a thermally conductive belt as shown in FIGS. 5 and 6 could replace the cylinder as a transport which would allow the heat transfer/moisture equilibrium process to occur before curl can set in without introducing a change of direction into the paper path. An advantage to using a vacuum cylinder 205 is that only one side of the copy sheet has to be contacted. If the non-imaged side of the sheet is used for tacking to the cylinder, there is no danger of toner sticking which enables the sheet to be acted upon immediately as it leaves the fuser. This will optimize the temperature gradient as well as reduce the time for curl to set. With the use of heat extraction mechanism 200, it is possible that the decurler in FIG. 1 can be eliminated.

The performance of heat extraction transport mechanism 200 is enhanced in FIG. 4 with the placement of a solid member 250 inside cylinder 205 in order to create an annular cross-section. The annular cross-section enables high velocities to be obtained near the outer wall for convection transfer of heat without increasing the overall flow requirement. Very high Nusselt number (convective heat transfer coefficient) have been demonstrated for this arrangement with axial velocities of 3 m/s which can be easily obtained using less than 20 cfm.

Convection in the annular region between insert 250 and the cylinder wall is enhanced greatly due to the relative tangential motion between the rotating cylinder wall and the cooler stationary insert. Besides creating a forced convection environment, the motion serves to disturb the thermal boundary layer at the wall creating a highly effective turbulent heat transfer. Ambient air is mixed with the heated radial inflow to maintain uniform wall temperature for enhanced conduction.

Figure 5A:
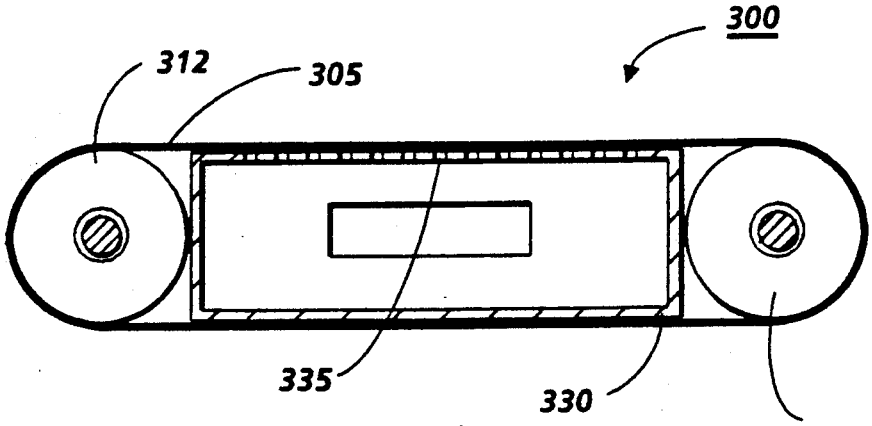
FIG. 5A is an elevational view of an alternative embodiment of the present invention which uses belts as a sheet transport and heat sink.
Figure 5B:
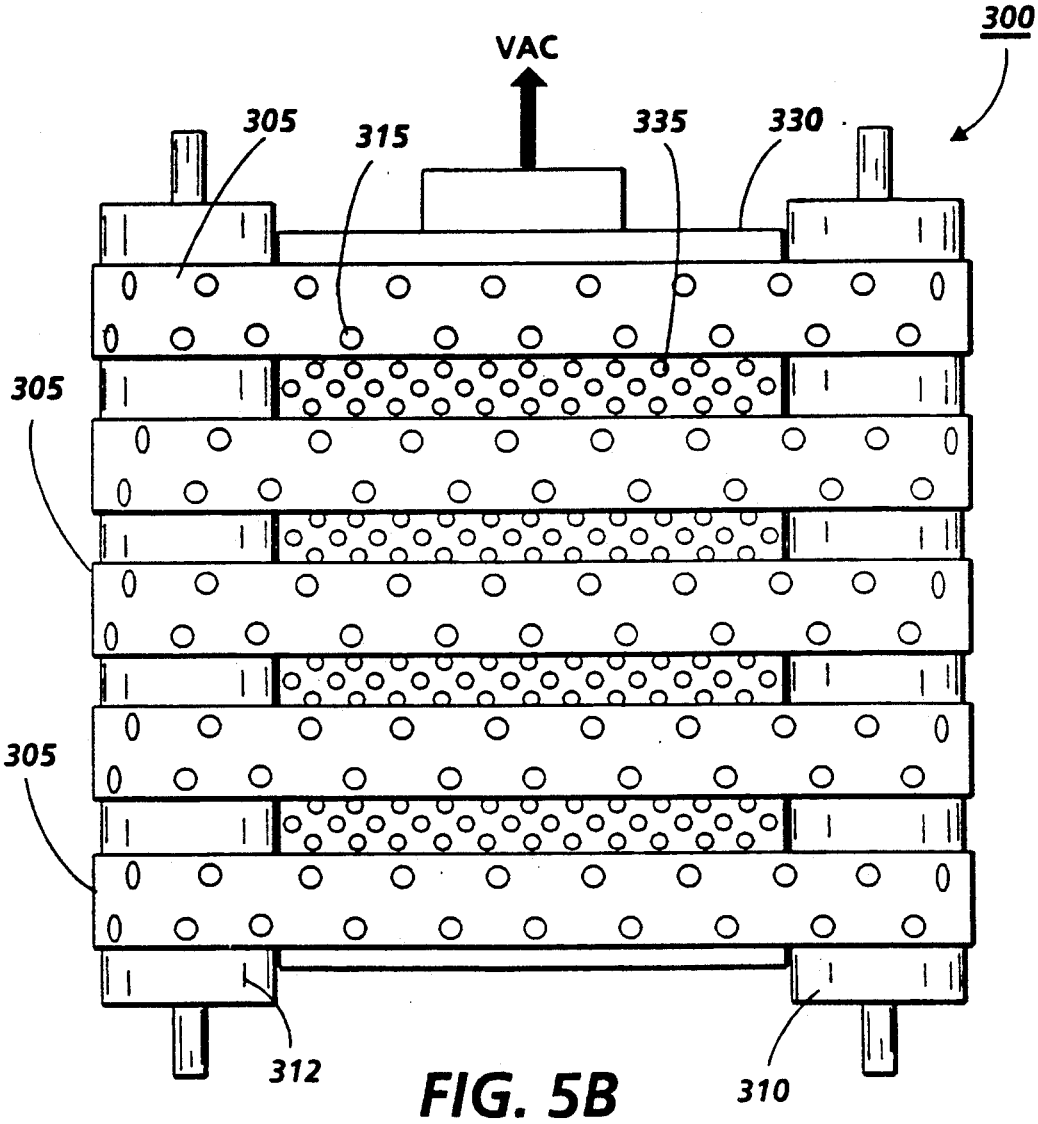
FIG. 5B is a plan view of the heat exchange transport device of FIG. 5.

In reference to the alternative embodiment of the instant invention in FIGS. 5A and 5B, a heat extraction device 300 is shown that is effective both as a heat removal device as well as a decurler and comprises a series of flat thermally conductive belts 305 which could be made of a metallic material. The belts have a high coefficient of friction and are entrained around a pair of rubberized rolls 310 and 312. A vacuum plenum 330 is positioned inside the belts and connected to a vacuum source. A plurality of holes 315 in the belts allows air to be drawn into holes 335 in vacuum plenum 330 by the vacuum source which tacks sheets to the surface of the belts for transport by the belts. While the holes 335 in the vacuum plenum 330 are shown throughout the top surface of the vacuum plenum, preferably they are only under belts 305. High velocity air flow created around the belts by the vacuum source provides cooling enhanced by turbulent flow through the holes in the belts. This device cools a sheet quickly and evaporates moisture in the sheet before curl can set in.

From the foregoing it is apparent that there is herein provided a heat extraction transfer roll apparatus capable of preventing curl in sheets processed by application of heat and pressure. The apparatus serves a sheet transport function and provides a highly enhanced convective heat transfer based on the use of both axial and tangential flows in an annular passage. A roughened surface is employed on the transport roll in order to enhance heat transfer and paper handling, and provide a pressure gradient for sheet moisture control. The invention has been described in detail with particular reference to preferred embodiments thereof, but it will be understood that variations and modifications can be effected within the spirit and scope of the invention as claimed.

What is claimed is:

1. In an apparatus for processing a sheet bearing a developed image, said apparatus having a fusing station for receiving the sheet being transported from an upstream location and rendering said developed image permanently affixed to the sheet by application of heat and pressure, the improvement for dissipating heat placed in the sheet by said fuser, characterized by:

thermally conductive transport means positioned downstream of said fuser and adapted to move the sheet away from said fuser for further processing while simultaneously causing heat within the sheet to dissipate, and where said transport means is a hollow cylinder with a plurality of holes extending through its outer and inner surfaces and includes a section of material inserted in the interior of said hollow cylinder to reduce the cross-section of said hollow cylinder and thereby create high velocities near said outer surface in order to increase heat transfer from the sheet; and insulative and reflective baffle means positioned adjacent to and adapted to work in conjunction with said transport means in dissipating heat from the sheet.

2. The apparatus of claim 1, including vacuum means adapted to communicate with the interior of said hollow cylinder and establish a partial vacuum therein.

3. The apparatus of claim 2, wherein said outer surface of said hollow cylinder is roughened in order to aid in propagating a low pressure field at said outer surface of said hollow cylinder which is used to tack the sheet to said outer surface and thereby aid in effective transport of the sheet, and aids in obtaining a uniform pressure gradient under the sheet, which in turn aids in establishing moisture equilibration in the sheet.

4. The apparatus of claim 1, wherein said baffle has a concave portion that is spaced from and compliments said outer surface of said hollow cylinder.

5. Apparatus for transporting and cooling a heated copy sheet as it is moved along a path which extends from a fuser, said apparatus comprising:

thermally conductive transport means adapted to move the copy sheet from the fuser for further processing while causing heat within the copy sheet to dissipate, said transport means comprising a hollow cylinder having holes in the surface thereof for the passage of air drawn therethrough by said vacuum means;

insulative and reflective baffle means adapted to work in conjunction with said hollow cylinder in dissipating heat from the copy sheet;

annulus means positioned inside said hollow cylinder and adapted such that increased axial air velocities are created near the outside surface of said hollow cylinder for high convection heat transfer from the copy sheet; and vacuum means adapted to attach the copy sheet to said transport means.

6. The apparatus of claim 5, wherein said hollow cylinder has a high frictional surface.

7. The apparatus of claim 6, wherein said high frictional outer surface of said hollow cylinder includes a plurality of fins.

8. In an apparatus for processing a sheet bearing a developed image, said apparatus having a fusing station for receiving the sheet and rendering said developed image permanently affixed to the sheet by application of heat and pressure, the improvement for dissipating heat placed in the sheet by said fuser, characterized by:

thermally conductive transport means configured as a hollow cylinder and adapted to transport the sheet from said fuser for further processing while causing heat within the sheet to dissipate, and including means positioned inside said hollow cylinder adapted to enhance internal flow of air within said hollow cylinder caused by vacuum means, said vacuum means being adapted to draw air through said hollow cylinder and thereby tack a sheet to the external surface of said hollow cylinder;

insulative and reflective baffle means positioned adjacent to and adapted to work in conjunction with said transport means in dissipating heat from the sheet;

convective means for removing moisture dispelled from the sheet by the fusing station; and a roughened external surface on said thermally conductive transport means to enhance both sheet transport and heat transfer from the sheet to said thermally conductive transport means.

9. The apparatus of claim 1, wherein said section of material creates an annulus within said hollow cylinder.

* * * * *